US006752137B2

(12) United States Patent
Brunette et al.

(10) Patent No.: US 6,752,137 B2
(45) Date of Patent: Jun. 22, 2004

(54) LESS-LETHAL LAUNCHER

(76) Inventors: James R. G. Brunette, 9713 Dunbarton Dr., Columbia, SC (US) 29223; Gary A Sniezak, 3708 Heyward St., Columbia, SC (US) 29205; Richard Vay Oney, 10310 Holden Rd., Baroda, MI (US) 49101; Steve Doehler, 737 Tallwood Dr., Charleston, SC (US) 29412

( * ) Notice: Subject to any disclaimer, the term of this patent is extended or adjusted under 35 U.S.C. 154(b) by 0 days.

(21) Appl. No.: 10/146,003

(22) Filed: May 15, 2002

(65) Prior Publication Data

US 2003/0127085 A1 Jul. 10, 2003

Related U.S. Application Data

(60) Provisional application No. 60/323,542, filed on Sep. 19, 2001.

(51) Int. Cl.[7] ..... F41B 11/02; F41B 11/06; F41B 11/32

(52) U.S. Cl. ..... 124/74; 124/73; 124/76; 89/1.41

(58) Field of Search ..... 124/56, 70, 71, 124/72, 73, 74, 75, 76, 77, 45, 48; 89/1.41; 42/105, 75.03

(56) References Cited

U.S. PATENT DOCUMENTS

| | | | | | |
|---|---|---|---|---|---|
| 2,801,624 | A | * | 8/1957 | Feltman | 124/72 |
| 4,733,489 | A | * | 3/1988 | Kurak | 41/77 |
| 4,819,609 | A | | 4/1989 | Tippmann | |
| 4,986,251 | A | * | 1/1991 | Lilley | 124/67 |
| 5,285,766 | A | * | 2/1994 | Milliman | 124/72 |
| 5,590,484 | A | | 1/1997 | Mooney et al. | |
| 5,622,160 | A | | 4/1997 | Casas Salva | |
| 5,634,456 | A | | 6/1997 | Perrone | |
| 5,832,911 | A | * | 11/1998 | Mayville et al. | 124/73 |
| 5,954,042 | A | * | 9/1999 | Harvey | 124/51.1 |
| 6,134,823 | A | * | 10/2000 | Griffin | 42/105 |
| 6,223,658 | B1 | | 5/2001 | Rosa et al. | |
| 6,532,947 | B1 | * | 3/2003 | Rosa et al. | 124/56 |

FOREIGN PATENT DOCUMENTS

| | | | | |
|---|---|---|---|---|
| WO | WO 9803834 A1 | * | 1/1998 | F41C/27/00 |

* cited by examiner

*Primary Examiner*—Charles T. Jordan
*Assistant Examiner*—John W. Zerr
(74) *Attorney, Agent, or Firm*—Michael A. Mann; Nexsen Pruet Adams Kleemeier, LLC

(57) ABSTRACT

The present invention is a projectile launching system having an independently operable gas powered less-lethal launcher, which is capable of firing projectiles containing either incapacitating, debilitating, or marking agents for use during those situations when lethal force would be an inappropriate response. The gas powered launcher is ergonomically designed and comprises a receiver housing and receiver that are detachable from a stand-alone stock so that it can be attached to a mounting bracket located underneath the barrel of a rifle and, therefore, integrated with such rifle in order to provide both a lethal and a less-lethal capability for the user. One of the ergonomic features of the receiver is that it is designed to releasably carry a compressed gas container in a way that presents a favorable profile and a convenient and efficient trigger location, even after attachment of the receiver to the barrel of a rifle.

20 Claims, 11 Drawing Sheets

45
84
44
75
74

48
52
46
59
77
47
38
78
76
80
82
66
86
42
43
68
58
41
49
39
40

92
89
92
90
89
94
97
95

LESS-LETHAL LAUNCHER

CROSS REFERENCE TO RELATED APPLICATIONS

This application claims the benefit of U.S. Provisional Application No. 60/323,542, filed on Sep. 19, 2001, which is incorporated herein by reference. Applicant claims the priority date benefits of that application.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISK APPENDIX

Not Applicable.

BACKGROUND OF THE INVENTION

The present invention relates generally to compressed gas powered guns and, more particularly, to compressed gas powered guns that are capable of firing projectiles with a high degree of accuracy.

Law enforcement and military personnel become involved in a broad range of situations on a daily basis from the ordinary and the mundane to the life threatening. In many instances, however, including the training of personnel, riot control, and airline security or other such special circumstances, the use of a lethal weapon, which, by definition, is capable of inflicting deadly force, is not always an appropriate response in these situations. Therefore, having a means to provide a less-lethal response for a wide range of activities is desirable and is sought after by law enforcement and military personnel.

Several less-lethal devices are known in the prior art including bb guns, which are designed to propel small spherically shaped metallic projectiles, and paint ball guns, which are designed to propel small spherically shaped frangible projectiles. Generally, both of these guns use compressed gas and are considered as children's toys, but adults are known to use both of these weapons for various activities including target shooting and simulated war games as well. Other well known examples of weapons that are generally considered as being less-lethal include stun guns, tear gas launchers, and even fire hoses.

These weapons, however, suffer from various flaws including either the need for direct contact with the intended target, which, in many instances, can lead to the law enforcement personnel becoming involved in an unnecessarily dangerous confrontation, or the need for the target to be within relatively close range due to inherent ballistic inaccuracies, which, in many instances, can cause innocent bystanders to become accidentally injured. Another flaw with these weapons is that they lack the flexibility to be able to offer a lethal response when necessary.

Therefore, a need remains for a less-lethal device that has a significant range, is accurate over that range, and is designed to be an integral part of a system that is also capable of providing lethal force when necessary.

BRIEF SUMMARY OF THE INVENTION

According to its major aspects and briefly recited, the present invention is a compressed gas powered less-lethal launcher and launcher system intended for use by law enforcement or military personnel that is capable of firing less-lethal projectiles during conflict situations not requiring the use of deadly force. More specifically, the compressed gas powered less-lethal launcher and launcher system, in one preferred embodiment, is comprised of six major components: a receiver; a receiver housing; a barrel; a compressed gas canister (or cylinder) that is detachably mounted to the receiver housing, which is used for storing compressed gas; a stock that can be detachably mounted to the receiver and/or receiver housing; and a magazine for holding a plurality of projectiles.

A feature of the present invention is that it is capable of launching frangible projectiles through the use of compressed gas, which allows the invention to provide a less-lethal response through a variety of marking and/or debilitating agents.

Another feature of the present invention is that it can accurately launch a projectile over a significant range, which provides the advantage of allowing the present invention to be effectively used from a safe distance.

Still another feature of the present invention is its ergonomic design, which includes such features as: being lightweight; having a conveniently mounted compressed gas cylinder, which presents an improved profile, and which allows the trigger to be conveniently and efficiently positioned; having two hand grips, and having an easy-to-use safety mechanism.

It is a further feature of the present invention to be mechanically and operationally simple to use, yet be highly durable and reliable.

An additional feature is that besides the present invention receiver and receiver housing being mounted onto the present invention stock, the present invention can also be mounted onto a rifle such as a standard military rifle, including, but not limited to, an M-4 or an M-16, which provides the advantage of having both a less-lethal and a lethal option conveniently available to the user.

Still other features of the present invention include its novel projectile magazine, projectile magazine attaching means, and optional loading system, which provides the benefits of ease-of-use and speed-of-loading the magazine and, therefore, the less-lethal launcher.

Other features and their advantages will be apparent to those skilled in the art from a careful reading of the Detailed Description of the Invention, accompanied by the drawings.

DETAILED DESCRIPTION OF THE INVENTION

Figure 1:
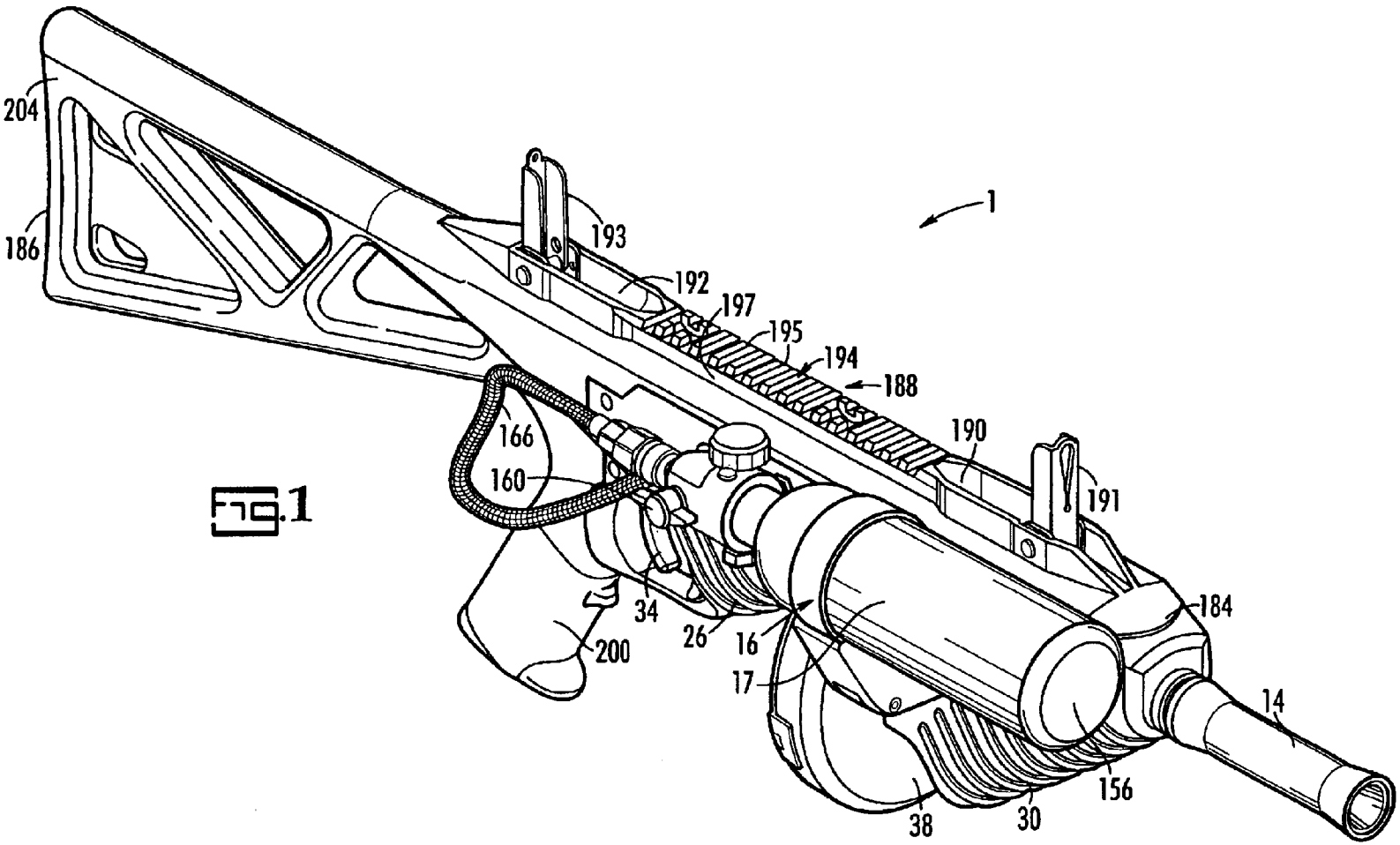
FIG. 1 is a perspective view of the less-lethal launcher, according to a preferred embodiment of the present invention.
Figure 2:
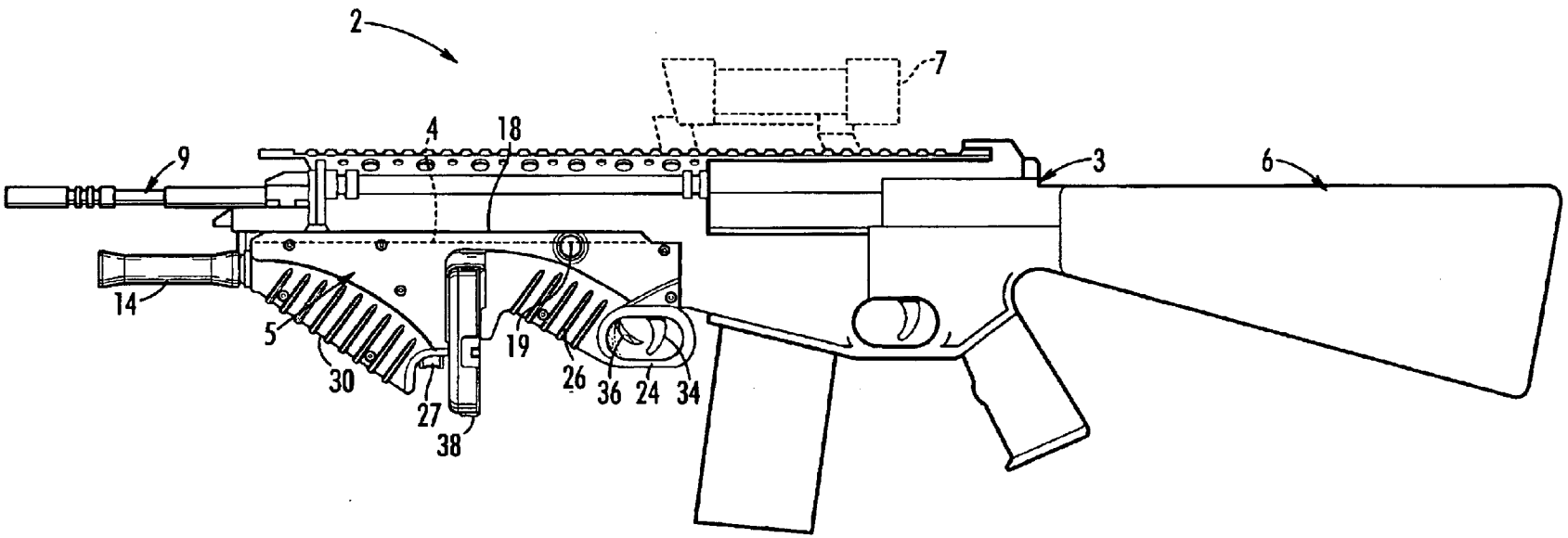
FIG. 2 is a left side view of the launcher system, according to a preferred embodiment of the present invention.
Figure 3A:
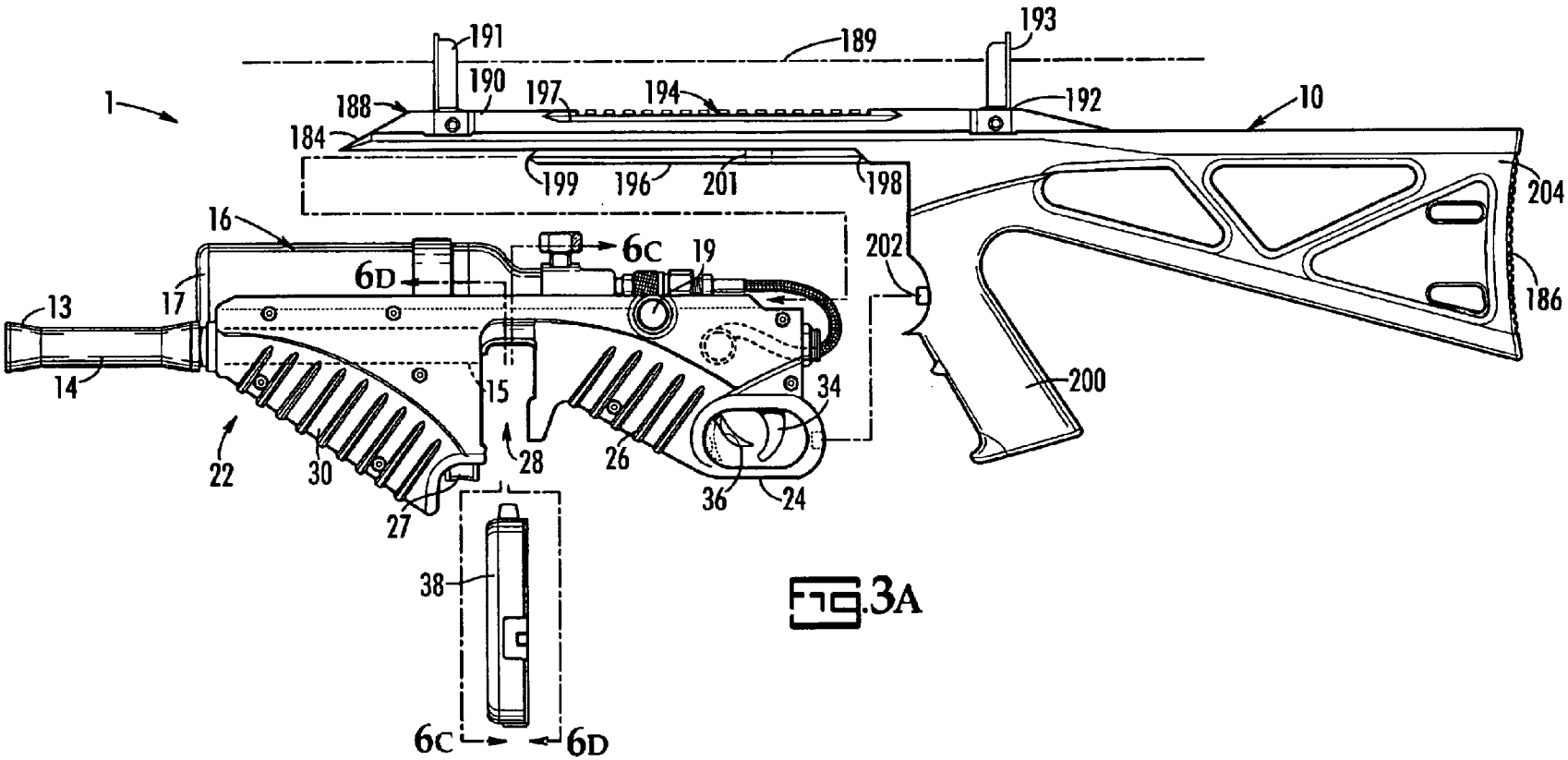
FIG. 3A is a left side exploded view of the less-lethal launcher, according to a preferred embodiment of the present invention.
Figure 3B:
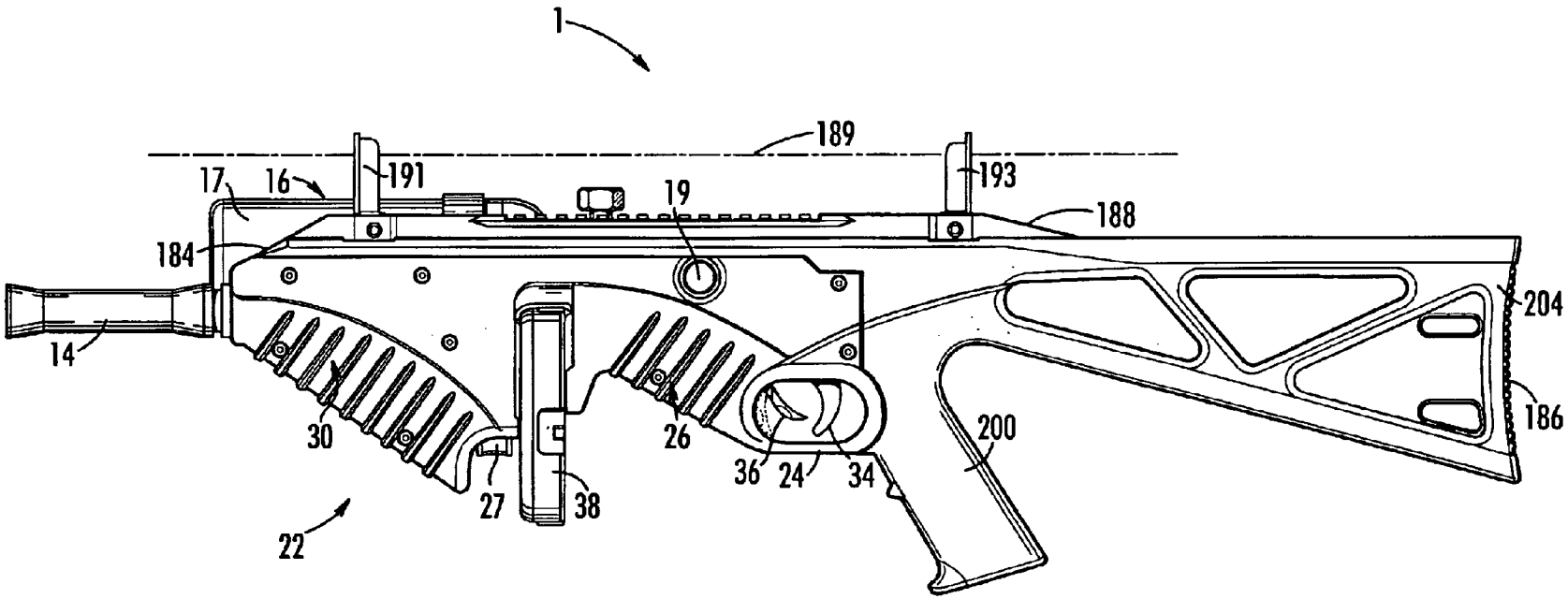
FIG. 3B is a left side view of the less-lethal launcher, according to a preferred embodiment of the present invention.

Referring specifically to FIG. 1 of the drawings, a preferred embodiment of the less-lethal launcher 1 of the present invention is shown. Preferably, the less-lethal launcher 1 discharges projectiles of the type, and in a manner, that allows the less-lethal launcher 1 of the present invention to be classified or characterized as a less-lethal launcher (or launching device). As shown in FIGS. 1, 3A, 3B, and 12, the less-lethal launcher 1 includes, among other components, a stock 10, a receiver 12, a receiver housing 22, a launcher barrel 14, and a compressed gas container assembly 16. The stock 10 allows the launcher to be held like a rifle. Alternatively, in another preferred embodiment of the present invention, as shown in FIG. 2, the receiver 12 and receiver housing 22 are used as part of a launcher system 2. The stock 10 can be removed from the less-lethal launcher 1 by depressing the release mechanism 19 on the left side of the receiver housing 22 (as shown in FIGS. 3A and 3B), and, preferably, the receiver 12 and the receiver housing 22 can be fitted to the underside of the barrel 9 of a rifle 3 (as shown in FIG. 2). Preferably, the rifle is a standard military rifle 3, including, but not limited to, an M-16, as shown in FIG. 2; however, the less-lethal launcher 1 is not limited to being attachable only to a rifle; therefore, any other suitable base for the less-lethal launcher 1 can be used as well. In operation, after being attached to a rifle 3, the launcher 1 and rifle 3 can be operated independently; however, the user of the launcher system 2 preferably uses the stock 6 and sights 7 of the rifle 3, to which the receiver 12 and the receiver housing 22 are attached, when firing either the projectile discharging portion 5 of the launcher system 2 or the rifle 3. Therefore, when the receiver 12, the receiver housing 22, and the rifle 3 are attached to form the launcher system 2, the launcher system 2 is provided with both a lethal and a less-lethal response capability, which increases the overall capability of the launcher system 2. Referring specifically to FIG. 2, the attachment of the receiver 12 (and the receiver housing 22) to a rifle 3 is achieved by slidably and securely connecting the receiver mounting bracket 18 of the launcher 1 (i.e, of the projectile discharging portion 5 of the launcher system 2) onto the adapter bracket assembly 4 attached to the rifle 3. To release the receiver 12 (and the the receiver housing 22) from the rifle 3, the user would operate the release mechanism 19 and then separate the receiver 12 (and the the receiver housing 22) from the rifle 3 by pulling them away from each other.

As shown in FIGS. 1, 3A, and 3B, a stock 10 having a receiver end 184 and an opposing butt end 186, includes, among other components, a sight rail 188 which extends along a longitudinal axis 189 from the butt end 186 to the receiver end 184 of the stock 10. The sight rail 188 has a front sight well 190, which carries a front sight 191, and a rear sight well 192, which carries a rear sight 193, and a mounting assembly 194 for mounting optional equipment. The mounting assembly 194, which is formed between the front sight well 190 and the rear sight well 192, is comprised of projections 195 lying transverse to the longitudinal axis 189 and may contain grooves 197 that are formed on both the right side and left side of the sight rail 188. The stock 10 also includes: a lower rail 196 having a tapered distal end 199 and an opposing receiver mounting bracket stop end 198, which may have a notch 201 that can be used for engaging and disengaging the stock 10 from the receiver 12 (and the the receiver housing 22); a pistol grip 200 formed on the lower surface of the stock 10, which has a trigger guard alignment pin 202 formed onto its forward surface; and a stock butt 204 formed on the butt end 186 of the stock 10. With the possible exception of the materials used to fabricate the sights 191 and/or 193 and the sight wells 190 and/or 192, all of which are preferably made of aluminum, the stock 10 and its above-described components are preferably made of nylon. However, the stock 10 and any or all of its components (including the sights and the sight mounting components) can be made of any other suitable material that will be able to withstand the stresses commonly associated with the use of a launcher stock including, in the case of the present invention, being repeatedly attached and detached from the receiver 12 (and the the receiver housing 22).

Figure 12:
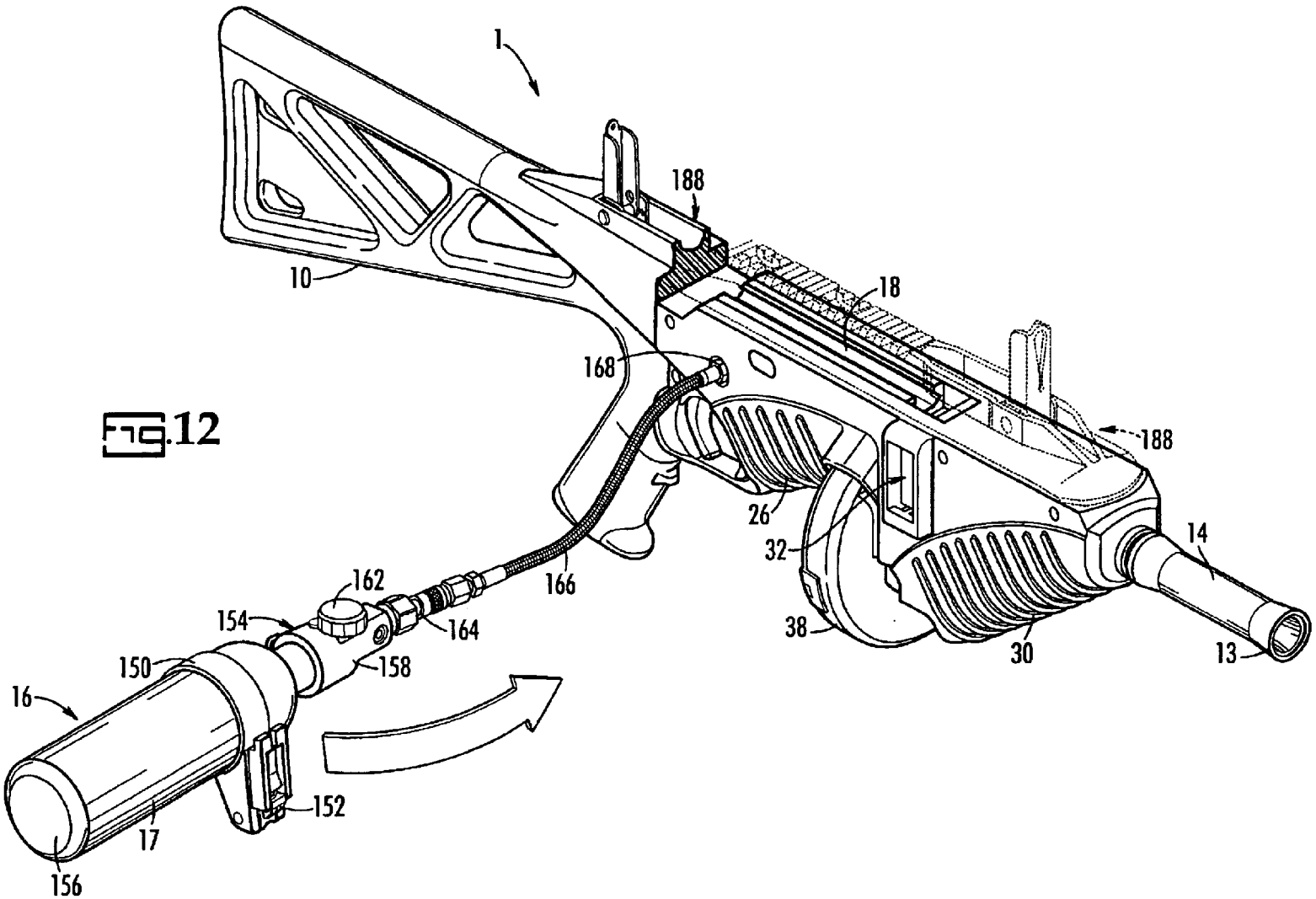
FIG. 12 is a perspective view of the less-lethal launcher, according to the preferred embodiment of the present invention as shown in FIG. 1.

As shown in FIGS. 1, 3A, 3B, 4, 5, and 12, the main receiver housing 22 includes, among other components: a receiver 12, which includes a trigger 34, a safety 36, and a receiver mounting bracket 18 having a release mechanism 19; a trigger guard 24; a first hand grip 26 located just forward of the trigger guard 24; a magazine well 28; a second hand grip 30; and a compressed gas container mounting bracket 32, which is preferably located on the right side of the main receiver housing 22, as shown in FIG. 12. Preferably, the main receiver housing 22, the release mechanism 19, the integral trigger guard 24, the first hand grip 26, the second hand grip 30, and the compressed gas container mounting bracket 32 are constructed of nylon; however, the main receiver housing 22 and any or all of the other described components can be constructed of any other suitable material that will be able to withstand the stresses associated with discharging projectiles using compressed gas and the use of the rifle 3 to which the receiver 12 (and the the receiver housing 22) may be attached. Relatedly, and preferably, the receiver 12, the mounting bracket 18, and the magazine well 28 are constructed of aluminum; however, the receiver 12 and these other components can be constructed of any other suitable metallic material that will be able to withstand the stresses associated with discharging less-lethal projectiles using compressed gas and the use of a rifle 3 to which the receiver 12 (and the the receiver housing 22) may be attached. A launcher barrel 14 having a muzzle end 13 and an opposing magazine end 15 is also attached to the main receiver housing 22, and is generally used to improve the accuracy and the range of a projectile being discharged from the less-lethal launcher 1 (or the projectile discharging portion 5 of the launcher system 2). Preferably, the launcher barrel 14 is constructed of aluminum; however, the launcher barrel 14 can be constructed of any other suitable material that will be able to withstand the stresses associated with discharging projectiles using compressed gas and the use of the rifle 3 to which the receiver 12 and the the receiver housing 22, i.e., the projectile discharging portion 5, may be attached.

Figure 4:
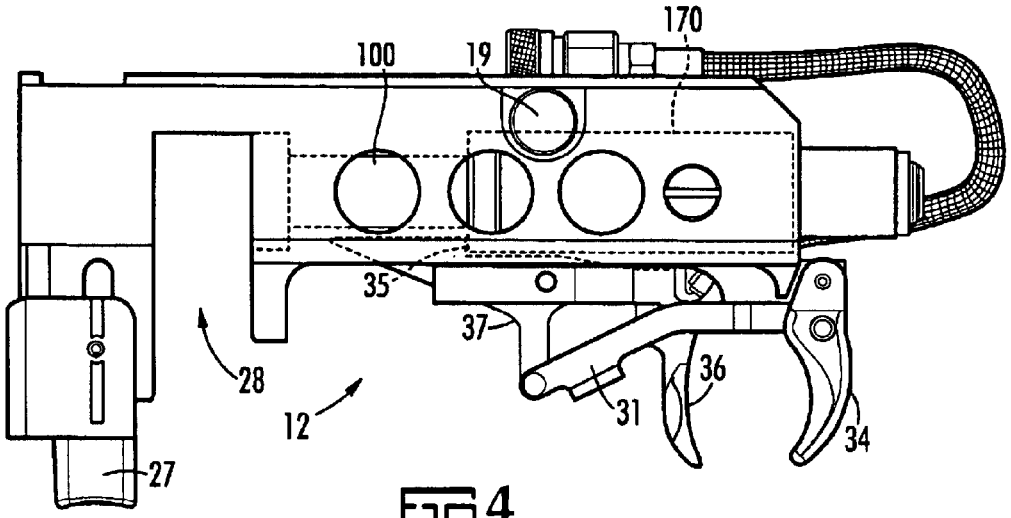
FIG. 4 is a left side view of the main housing of the receiver, according to a preferred embodiment of the present invention.
Figure 5:
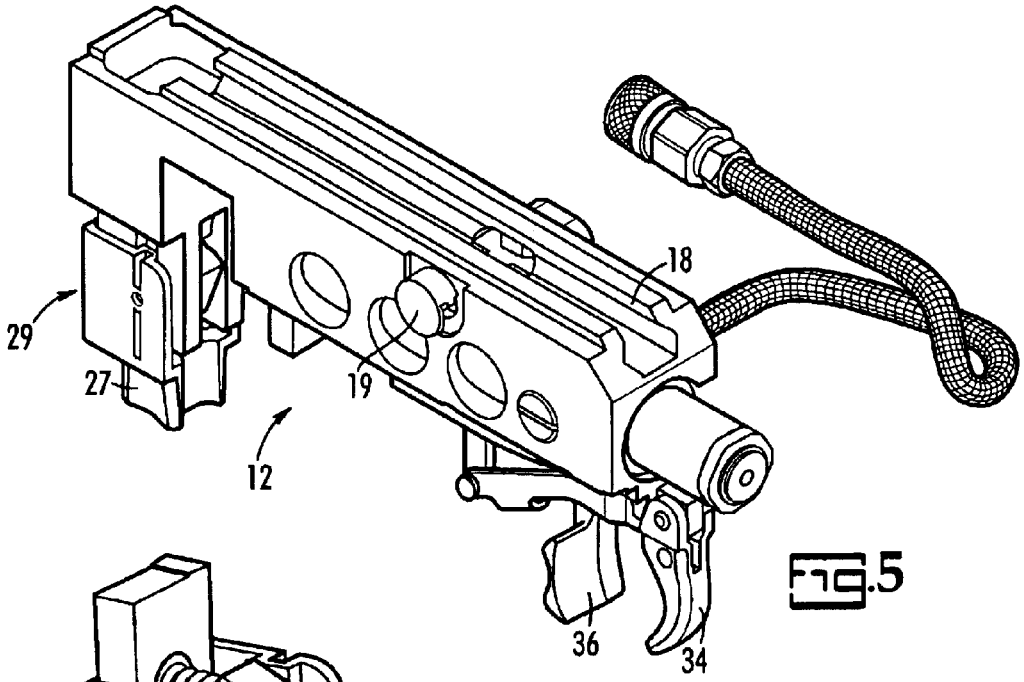
FIG. 5 is a perspective view showing the trigger and safety, according to a preferred embodiment of the present invention.

The trigger guard 24 surrounds the trigger 34, and the trigger safety 36, which is pivotally attached to the receiver 12. The trigger safety 36 can be placed in either a "safe" position, in order to block operation of the trigger 34 and, therefore, the projectile discharging launcher 1 or that portion of the launcher system 2, (with the "safe" position being shown in FIGS. 3A and 3B), or in a "fire" position, which is shown in phantom. FIGS. 4 and 5 illustrate the trigger mechanism's internal structure, and features the structure of the trigger safety 36. As FIGS. 3A and 3B clearly show, the trigger safety 36 of the present invention benefits the user by providing a readily discernable visual indication as to whether it is, or it is not, in the "safe" position.

Figures 6A, 6B:
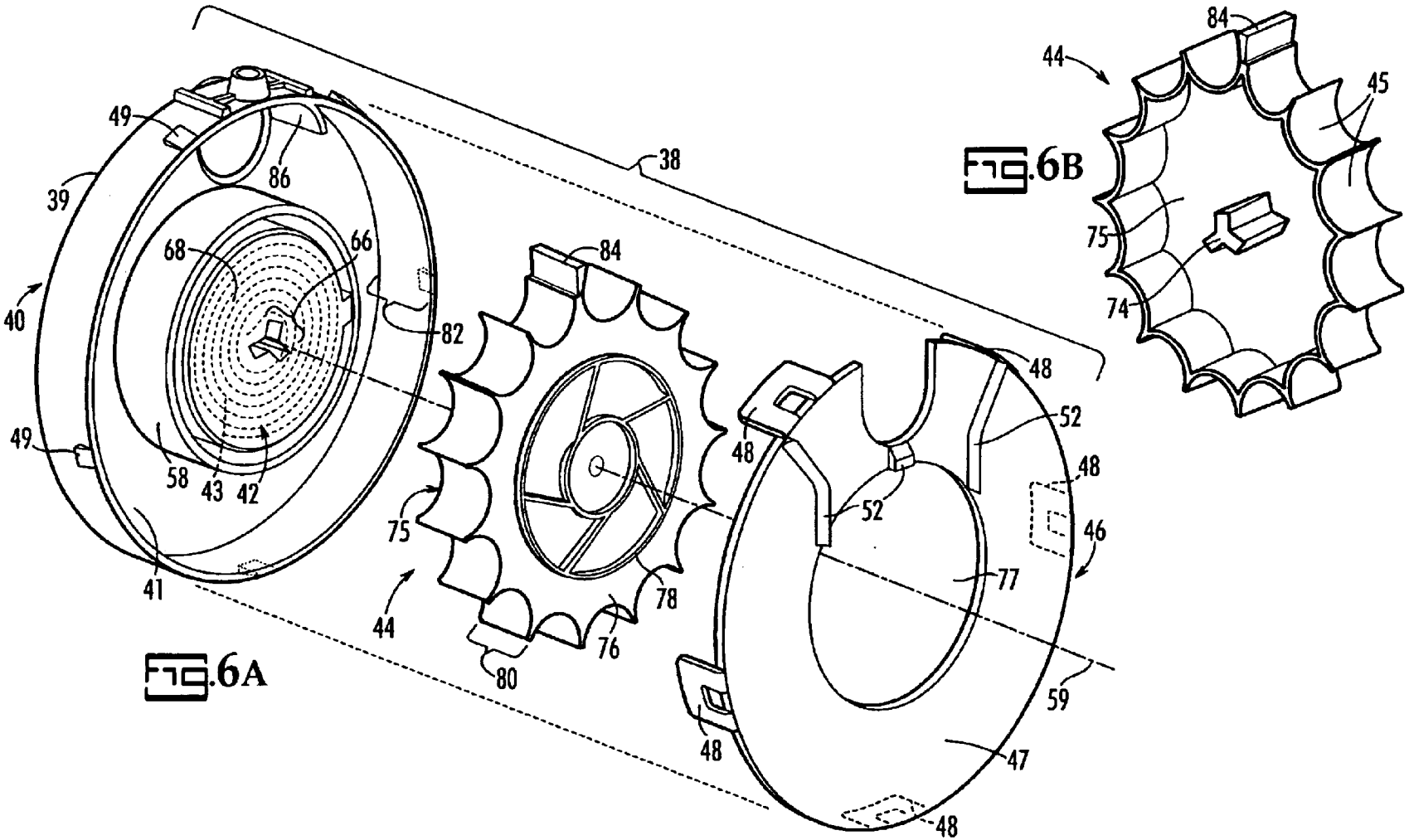
FIG. 6A is an exploded perspective view of the magazine, according to a preferred embodiment of the present invention.
FIG. 6B is an front perspective view of the rotor wheel, according to a preferred embodiment of the present invention.
Figure 6D:
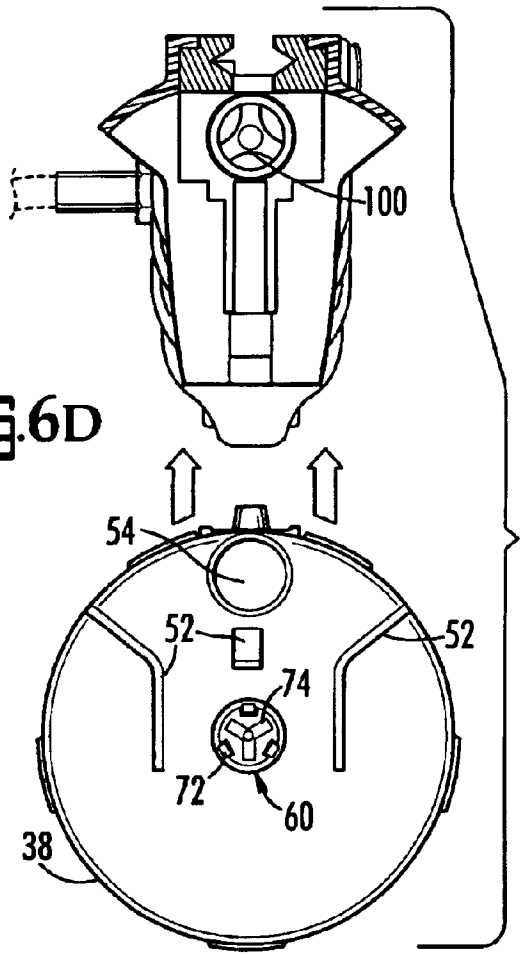
FIG. 6D is an exploded rear cross-sectional view of the magazine release mechanism assembly and the magazine, according to a preferred embodiment of the present invention.
Figure 6C:
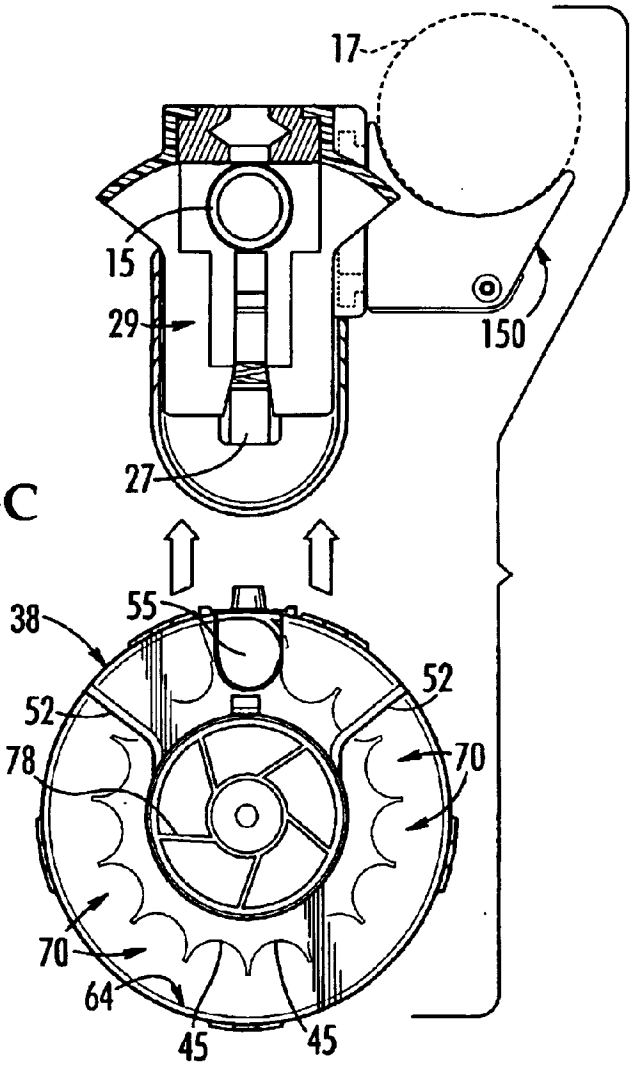
FIG. 6C is an exploded front cross-sectional view of the magazine release mechanism assembly and the magazine, according to a preferred embodiment of the present invention.

The magazine assembly 38 is shown in FIG. 6A. The magazine assembly 38 is of the carousel type and, preferably, holds about 15 projectiles in individual chambers. The magazine assembly includes a front housing 40 having a front surface 39, a spring housing 42, a carousel-type rotor wheel 44, and a rear housing 46 having a rear surface 47. Preferably, with the exception of the spring 43 in the spring housing 42, which is preferably made of steel, all of the other magazine assembly 38 components are made of plastic; however, these components can be made of any other suitable material that is able to withstand the stresses associated with discharging projectiles, being repeatedly inserted and removed from the magazine well 28, being repeatedly loaded, and any of the other stresses associated with operating and servicing a projectile magazine assembly 38 under various operating conditions. Preferably, the front housing 40 and/or the front surface 39 is opaque in order to prevent any individual, which may be the user's intended target, from viewing the contents of the magazine assembly 38, while the rear housing 46 and/or the rear surface 47 is translucent in order to provide the user with the capacity of readily ascertaining the type and number of projectiles remaining in the magazine assembly 38. Preferably the front housing 40 and the rear housing 46 are connected together or mated by means of snap fittings 48 and 49; however, these housings can be connected together or mated by any other suitable means including, but not limited to the use of inside or outside threads, or tabs. When the front housing 40 and the rear housing 46 are connected together, or mated, they generally form a hollow cylindrical container within which the spring housing 42 and the rotor wheel 44 are carried. To carry the spring housing 42 and the rotor wheel 44, the inside surface 41 of the front housing 40 has a spring housing mounting assembly that includes a cylindrical bracket 58, which is slightly larger in diameter than the spring housing 42, and a centrally located aperture 60 that is formed through the front housing 40, which allows the spring housing 42 to be retained inside the cylindrical bracket 58 while still allowing the spring housing 42 to freely rotate about a center axis 59 for proper operation during the loading and the chambering of the projectiles.

The spring housing 42 includes a rotor wheel mounting key guide 66 formed on its rear surface 68, and a retainer 72 that is inserted through the front housing aperture 60 for the purposes previously described, i.e., for retaining yet allowing free rotation of the spring housing 42. The spring housing 42 carries a spring 43, which is wound during the loading of projectiles into the chambers 70, which are the areas defined by the rotor wheel sections 45 and the inside surface along the radial edge 64 of the front housing 40. Since the spring housing 42 is connected to the rotor wheel 44 through the insertion of the rotor wheel key 74 into the rotor wheel mounting key guide 66, the winding of the spring 43 allows the spring housing 42 to provide the force needed for rotating the rotor wheel 44 to advance the chambers 70 during the discharging of the less-lethal launcher 1 or the projectile discharging portion 5 of the launcher system 2. To prevent over-winding of the spring 43 the rotor wheel 44 has a rotor stop surface 84 that comes into contact with a front housing stop surface 86 when the spring 43 is fully wound for operational purposes. The front housing stop surface 86 also functions as a projectile advance stop by preventing the rotor wheel 44 from advancing until the projectile 88 and/or 92 in a chamber 70 is discharged from the launcher 1 or the projectile discharging portion 5 of the launcher system 2 and the bolt 100 has been retracted from that chamber 70 after discharging a projectile 88 and/or 92 during the discharge sequence, which will be discussed in the following paragraphs.

Preferably, the rotor wheel 44, as shown in FIGS. 6A and 6B, is generally cylindrically shaped and has a rotor wheel front surface 75 and an opposing rotor wheel rear surface 76. The front surface 75 of the rotor wheel 44 has a rotor wheel key 74 formed thereon that extends away from the rear surface 76 of the rotor wheel 44, and the rear surface 76 preferably has a grip 78 formed thereon for assisting the user in turning the rotor wheel 44 during the loading of the chambers 70. Preferably, with the exception of a portion of the retainer 72 that extends through the aperture 60 of the front housing 40 after fully inserting the rotor wheel key 74 into the rotor wheel mounting key guide 66, the cylindrical bracket 58 of the front housing 40, and the spring housing 42, will be carried within the rotor wheel 44. Preferably, the height 80 of the rotor wheel 44 is slightly smaller than the inside dimension 82 of the assembled magazine assembly 38, and the inside dimension 82 is slightly larger than the length of any of the projectiles 88 and/or 92 that can be propelled from the less-lethal launcher 1 or the projectile discharging portion 5 of the launcher system 2. Preferably, the magazine assembly 38 will have at least one alignment guide 52 formed on at least one of its outer surfaces, such as the front surface 39 of the front housing 40 and/or the rear surface 47 of the rear housing 46, for assisting the user in properly inserting and/or seating the magazine assembly 38 into the magazine well 28 on the receiver 12 (which is carried by the receiver housing 22). Preferably, the magazine assembly 38 will have a projectile discharge aperture 54 formed through the front housing 40, a projectile loading aperture 55 formed through the rear housing 46, and a rotor access aperture 77 also formed through the rear housing 46 for manually turning the rotor wheel 44 by turning the rotor grip 78 during a loading operation.

Figure 7:
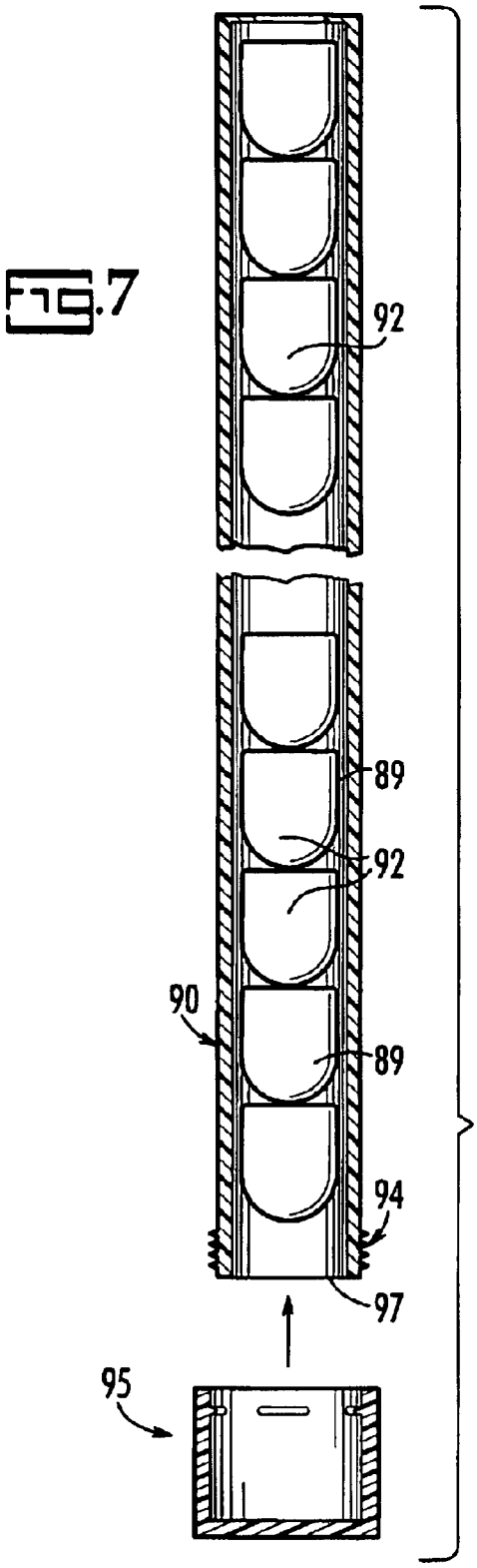
FIG. 7 is an exploded cross sectional view of the projectile storage tube, which is used to store projectile prior to loading the magazine, according to a preferred embodiment of the present invention.
Figure 8:
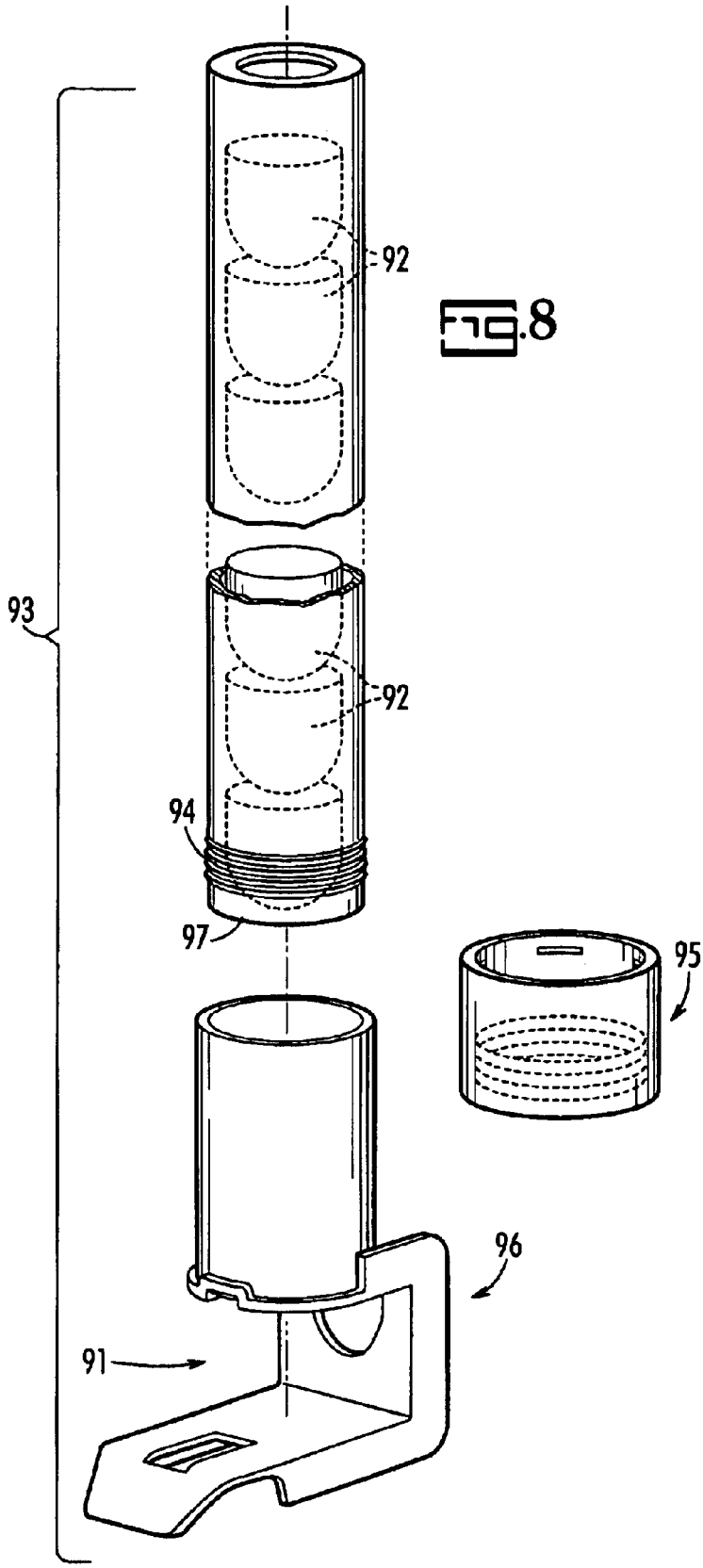
FIG. 8 is an exploded perspective view of the projectile loading system, according to a preferred embodiment of the present invention.
Figure 9A:
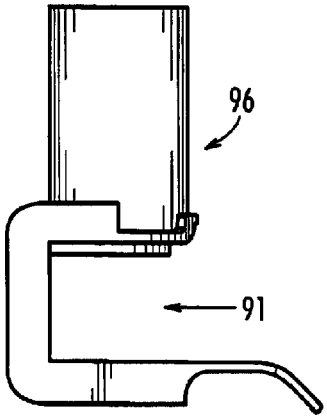
FIG. 9A is a left side view of the projectile storage tube reloading clamp, according to a preferred embodiment of the present invention.
Figure 9B:
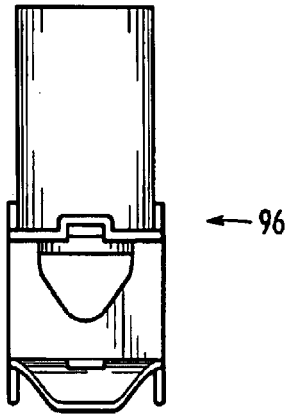
FIG. 9B is a front view of the projectile storage tube reloading clamp of FIG. 9A.
Figure 9C:
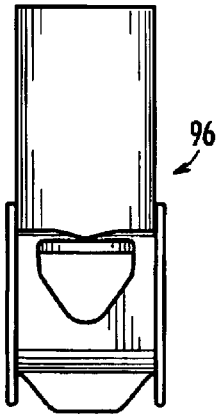
FIG. 9C is a rear view of the projectile storage tube reloading clamp of FIG. 9A.
Figure 9D:
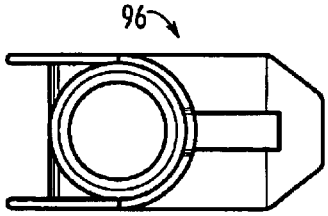
FIG. 9D is a top view of the projectile storage tube reloading clamp of FIG. 9A.

Preferably, the magazine assembly 38 is loaded through the use of the projectile storage tube 90, which is shown in FIG. 7. The projectile storage tube 90, is used to store the projectiles 88 and/or 92 prior to loading the magazine assembly 38 and, is a part of an optional loading system 93, as shown in FIG. 8. Preferably, the projectile storage tube 90 is a hollow cylindrical tube with one end of the tube 90 having external threads 94 formed thereon for threadably receiving a cap 95. Preferably, the storage tube 90 is tapered so that the widest end of the projectile storage tube 90 is the end with the external threads 94. For proper reloading of a magazine assembly 38, the magazine loading adapter 96, as shown in FIGS. 8, and 9A–9D, is formed to receive the threaded end 97 of the uncapped projectile storage tube 90 and to hold that threaded end 97 in a spaced relationship to the magazine assembly 38, which during loading would be attached to the magazine loading adapter 96 by fully inserting the magazine assembly 38 into the loading port 91 of the magazine loading adapter 96. Preferably, both the magazine assembly 38 and the magazine loading adapter 96 are designed so that only one orientation of the magazine assembly 38 into the magazine loading adapter 96 results in an easy, i.e., non-forced, insertion of the magazine assembly 38 into the loading port 91. By designing the loading system 93 and the magazine assembly 38 in this way allows for the non-spherical projectiles 92 to be properly oriented in the chambers 70 during loading, which allows the user the opportunity to obtain any benefits attributable to the ballistic characteristics of the non-spherical projectiles 92.

Figure 11:
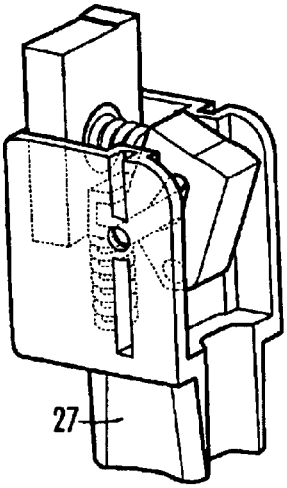
FIG. 11 is a detailed perspective view of the magazine release mechanism, according to a preferred embodiment of the present invention.

In operation, and preferably, the magazine assembly 38 is loaded by the user inserting the magazine assembly 38, with the proper orientation, into the loading port 91 of the loading system 93. The user then removes the cap 95 from a projectile storage tube 90 and attaches the projectile storage tube 90 onto the magazine loading adapter 96 while the threaded end 97 of the projectile storage tube 90 is located below the magazine loading adapter 96. The user then inverts the magazine assembly 38 and the loading system 93 so that a projectile 88 or 92 can fall into an empty chamber 70 due to the force of gravity acting on the projectile 88 or 92. The user then manually turns the grip 78 so that each empty chamber 70 that passes beneath the projectile loading aperture 55 can be filled with a projectile 88 or 92 from the projectile storage tube 90. The user continues with this filling procedure until the magazine assembly 38 is completely filled with projectiles 88 or 92, until the projectile storage tube 90 is empty, or until the user no longer desires to continue loading the magazine assembly 38. The loading procedure described above is for illustrative purposes only and is just one of the many ways that the magazine assembly 38 can be loaded. For example, in another preferred embodiment, in which the loading system 93 is not used, the user blocks the projectile discharge aperture 54 and an uncapped projectile storage tube 90 is manually held directly above the projectile loading aperture 55 while the grip 78 is being manually turned. Therefore, these procedures should not be construed to be limiting, and that any other suitable loading procedure can be used and should be viewed as being encompassed by the present invention. Preferably, once the magazine assembly 38 is loaded, the user can insert the magazine assembly 38 into the magazine well 28, while taking care to orient the magazine assembly 38 so that the front housing 40 is pointed toward the launcher barrel 14 and the rear housing 46 is pointed away from the launcher barrel 14, i.e, with respect to the launcher barrel 14 the front housing 40 of the magazine assembly 38 is proximally located while the rear housing 46 of the magazine assembly 38 is distally located. Referring to FIGS. 2, 3A, and 3B, a magazine assembly 38 that is inserted and seated in the magazine well 28, can be released by manipulating the magazine release button 27, which is a part of the magazine release mechanism 29 shown in FIGS. 4, 5, and 11.

Figure 10A:
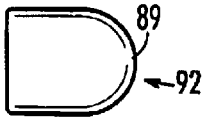
FIG. 10A is a side view of the hemispherical projectile that can be used with the present invention, according to a preferred embodiment of the present invention.
Figure 10B:
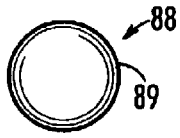
FIG. 10B is a side view of the spherical projectile that can be used with the present invention, according to a preferred embodiment of the present invention.
Figure 10C:
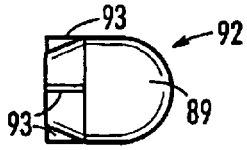
FIG. 10C is a side view of the hemispherical projectile that can be used with the present invention, according to a another preferred embodiment of the present invention.

Now referring to FIGS. 10A, 10B and 10C, the hemispherical head projectile 92 and the spherical projectile 88 are shown. The hemispherical head projectile 92 is hemispherical on one end and cylindrical on the other end, and may also have small fins 93, which may be used to stabilize the hemispherical head projectile 92 in flight. The orientation of the hemispherical head projectile 92 is critical to its range, accuracy and operation of the less-lethal launcher 1 (and the projectile discharging portion 5 of the launcher system 2). Therefore, when placed in the projectile storage tube 90 the hemispherical head projectile 92 should be oriented so that all of the hemispherical heads point to the threaded end 97 of the projectile storage tube 90, as shown in FIG. 7. With respect to the projectiles 88 and/or 92, both are capable of being filled and/or covered with a wide variety of debilitating or incapacitating chemical agents, and/or marking agents including, but not limited to, an odorant, an infrared or ultraviolet light sensitive dye, "pepper" gas, a luminescent or phosphorescent dye, and/or any other suitable debilitating or incapacitating agent, or marking means. Preferably, the shells 89 of the projectiles 88 and/or 92 are elastomer shells such as those commonly used for paint balls, and are made using commonly available methods; however, the shells 89 can be made of any other suitable material or by any other suitable method that, preferably, will allow a discharged projectile to break upon impact with a target while not allowing the shell's 89 pre-impact structural integrity to be compromised because of the material and/or substance carried by and/or contained within the shell 89.

Now, while specifically referring to FIGS. 1 and 12, the compressed gas container mounting bracket 32, and the compressed gas container assembly 16 are shown. The compressed gas container assembly 16 has a head end 154 and a bottom end 156. The compressed gas container assembly 16 includes, among other components: a compressed gas container 17; a container attachment member 150, which is securely attached to the compressed gas container 17, and which is used for mounting the container assembly 16 onto the compressed gas container mounting bracket 32, which is integrally formed on the receiver housing 22; and a compressed gas container head assembly 158, which is, preferably, threadably attached to the compressed gas container 17. As mentioned, and preferably, the compressed gas container assembly 16 is mounted to the receiver housing 22 parallel to the launcher barrel 14 by inserting the upper end of the container attachment member 150 to the compressed gas container mounting bracket 32, which is preferably located near the magazine end 15 of the launcher barrel 14, and then rotating the lower end of the container attachment member 150 until the container attachment member 150 clips into the container mounting bracket 32. To release the compressed gas container assembly 16 from the compressed gas container mounting bracket 32, a latch 152, which is carried by the container attachment member 150 can be manipulated to effect such release. Preferably, the head assembly 158 has a gas control valve 160, a pressure gauge 162, and an outlet gas hose fitting 164. The outlet gas hose fitting 164 is used for attaching a high pressure gas hose 166 between the compressed gas container 17 and the inlet compressed gas hose fitting 168, which is attached to the gas block 170 carried by the receiver 12. Preferably, outlet gas hose fitting 164 (or another fitting not shown) can be used to refill the compressed gas container 17 while it is still attached to the launcher 1 or the launcher system 2. Once a filled compressed gas container 17 is mounted onto the receiver housing 22 and the gas control valve 160 is in the "off" position, a high pressure gas hose 166 can be attached to the outlet gas hose fitting 164 and the inlet compressed gas hose fitting 168. After attaching the high pressure gas hose 166, the gas control valve 160 can be placed in the "on" position and the compressed gas contained within the compressed gas container 17 can then be supplied to the gas block 170. Preferably, all of the components in fluid communication with the high pressure gas are made of materials and are designed so that they meet or exceed the DOT and/or any other appropriate standards associated with these components.

As shown by the figure, in operation, the less-lethal launcher 1 includes the launcher barrel 14, the receiver 12, the receiver housing 22, the stock 10, the compressed gas container assembly 16, the magazine assembly 38, and all of the other related and associated components described above. In the following description of the less-lethal launcher 1 in operation, it is assumed that the following is extant: the receiver 12 (and the receiver housing 22) is mounted to the stock 10; the magazine assembly 38 is loaded with projectiles 88 or 92 and is properly inserted into the magazine well 28; the compressed gas container assembly 16 including a filled compressed gas container 17 is attached to the receiver housing 22; the high pressure gas hose 166 is connected between the outlet gas hose fitting 164 of the compressed gas container assembly 16 and the inlet compressed gas fitting 168 carried by the receiver 12 (and the receiver housing 22); the gas control valve 160 is in the "on" position; the safety 36 is in the "fire" position; and the bolt 100 is in its rearward position in preparation for a discharge sequence. Once a target is sighted, preferably by using the forward sight 191 and the rear sight 193 carried by the stock 10, the user is ready to discharge a projectile 88 or 92 through the launcher barrel 14 of the less-lethal launcher 1 by squeezing the trigger 34 until a projectile 88 or 92 is discharged. During the discharge sequence the following occurs: the trigger 34 is squeezed, which pivots a trigger link 31 and which causes a valve (not shown) in the valve chamber to close the supply of high pressure gas to the already pressurized valve chamber; the sear 37 is rotated so that it disengages a bolt flange 35, which causes the bolt 100, due to the release and expansion of the pressurized gas, to move away from its rearward position against the spring force applied by the bolt spring (not shown); the bolt 100 continues this forward movement until it contacts a projectile 88 or 92 in the magazine assembly 38 and pushes that projectile 88 or 92 out of the magazine assembly 38 and approximately one-quarter of one inch from the magazine assembly 38 (into the launcher barrel 14), which is the bolt's 100 forward most position; a plunger (not shown) that is carried within the bolt 100 is simultaneously pulled back from the plunger's "closed" position so that the pressurized gas remaining in the valve chamber is allowed to expand and flow through the bolt 100 and out of the less-lethal launcher 1 through the launcher barrel 14 and, thereby, simultaneously propelling the projectile 88 or 92 through the launcher barrel 14 and out of the less-lethal launcher 1; once the pressure in the valve chamber is sufficiently reduced, the force of the bolt spring returns the bolt 100 to its rearward position the following actions generally occur: the next projectile 88 or 92 in the magazine assembly 38 is chambered (through the rotation of the rotor wheel 44); the sear 37 once again engages the bolt flange 39; the trigger 34 returns to its forward position; and the valve chamber is repressurized with high pressure gas in order to repeat the discharge sequence.

In another preferred embodiment of the present invention, the previously described launcher system 2 can be formed by removing the stock 10 from the receiver 12 (and the receiver housing 22) and, therefore, removing their associated components from the less-lethal launcher 1, and mounting the receiver 12 (and the receiver housing 22) and their associated components to the underside of the barrel 9 of a standard military rifle 3 such as an M-16 as shown in FIG. 2, or to any other suitable base. In this embodiment, the operation of the projectile discharging portion 5 of the launcher system 2 is the same as that previously described for the less-lethal launcher 1, with the exception that the projectile discharging portion 5 uses the stock 6 and sights 7 of the rifle 3 to which the projectile discharging portion 5, i.e., the receiver 12 and the receiver housing 22, is attached. As shown in FIG. 2, and as previously mentioned, the attachment of the receiver 12 (and the receiver housing 22) to the rifle 3 is achieved through the use of an adapter bracket assembly 4 that is attached to the rifle 3, onto which the receiver mounting bracket 18 can be slidably and securely attached. By allowing a user the capability of orienting the receiver 12 and the receiver housing 22, i.e., the projectile discharging portion 5 of the launcher system 2, and the rifle 3 in this way to form the launcher system 2, gives the user the capability of operating both the projectile discharging portion 5 and the rifle 3 portion independently, which improves the overall performance and usability of the launcher system 2, and which provides the user with both a lethal and a less-lethal response capability.

While the invention herein disclosed has been described by means of specific embodiments and applications thereof, numerous modifications, and variations could be made thereto by those skilled in the art without departing from the spirit and scope of the present invention. Accordingly, the scope of the invention should be determined not by the embodiments illustrated, but by the appended claims and their legal equivalents.

What is claimed is:

1. A launcher, comprising:

a. a barrel, said barrel having a muzzle end and an opposing magazine end;

b. a receiver in operational connection with said barrel so that a projectile can be fired from said receiver through said barrel from said magazine end of said barrel to and out of said muzzle end of said barrel, said receiver having a barrel end and an opposing trigger end, said receiver having an upper side and an opposing lower side, said receiver having a right side and an opposing left side;

c. a receiver housing for carrying said receiver and said barrel, said receiver housing having a receiver housing barrel end and an opposing receiver housing trigger end, said receiver housing having a receiver housing upper side and an opposing receiver housing lower side, said receiver housing having a receiver housing right side and an opposing receiver housing left side;

d. a stock attached to said receiver and in operational connection with said receiver and said receiver housing;

e. a trigger, said trigger carried by said receiver;

f. a trigger safety operationally linked to said trigger, said trigger safety providing visual indication of its position;

g. a trigger guard carried by said receiver housing, said trigger guard surrounding said trigger and said trigger safety, wherein said trigger safety is operable by a user's trigger finger while said user's trigger finger is within said trigger guard;

h. a compressed gas container carried by and in operational connection with said receiver and said receiver housing so that gas from said compressed gas container can be used to discharge a projectile from said barrel; and i. a projectile magazine received within said receiver housing, said projectile magazine located adjacent to said magazine end of said barrel when received by said receiver housing.

2. The launcher as recited in claim 1, further comprising:

a. a forward hand grip integrally formed on said receiver housing, said forward hand grip located on said receiver housing lower side and on said receiver housing barrel end; and b. a rear hand grip integrally formed on said receiver housing, said rear hand grip located on said receiver housing lower side between said forward hand grip and said receiver housing trigger end.

3. The launcher as recited in claim 2, further comprising:

a. a magazine well for receiving said projectile magazine, said magazine well carried by said receiver housing between said forward hand grip and said rear hand grip; and b. a projectile magazine release mechanism, said projectile magazine release mechanism carried by said magazine well.

4. The launcher as recited in claim 1, further comprising:

a. a compressed gas container mounting bracket integrally formed on said receiver housing for operationally connecting said compressed gas container to said receiver housing.

5. The launcher as recited in claim 4, wherein said compressed gas container mounting bracket is located on said receiver housing right side.

6. The launcher as recited in claim 4, wherein said compressed gas container mounting bracket is located between said projectile magazine when received by said receiver housing and said muzzle end of said barrel.

7. The launcher as recited in claim 4, further comprising a mounting clip having a release mechanism, said mounting clip is attached to said compressed gas container for mounting said compressed gas container onto said receiver housing by inserting said mounting clip into said compressed gas container mounting bracket, said release mechanism is used for releasing said mounting clip from said compressed gas container mounting bracket.

8. A launcher system, said system comprising:

a. a barrel, said barrel having a muzzle end and an opposing chamber end;

b. a receiver in operational connection with said barrel so that a projectile can be fired from said receiver through said barrel, said receiver having a barrel end and an opposing trigger end;

c. a receiver housing, said receiver housing carrying said receiver;

d. a projectile magazine received within said receiver for holding plural projectiles;

e. a compressed gas container carried by said receiver housing and in operational connection with said receiver so that gas from said compressed gas container can be used to discharge said plural projectiles from said barrel;

f. a compressed gas container mounting bracket integrally formed on said receiver housing for operationally connecting said compressed gas container to said receiver housing, and wherein said compressed gas container mounting bracket is located between said projectile magazine when received by said receiver housing and said muzzle end of said barrel; and g. means for detachably mounting said receiver and said receiver housing onto a holder.

9. The launcher system as recited in claim 8, wherein said holder is a firearm stock.

10. The launcher system as recited in claim 8, wherein said holder is a rifle.

11. The launcher system as recited in claim 9, wherein said holder is a military rifle.

12. The launcher system as recited in claim 8, wherein said mounting means further comprises:

a. a mounting rail attached to said holder; and b. a receiver housing mounting bracket carried by said receiver housing, wherein said mounting rail and said receiver housing mounting bracket provide said mounting means with a quick connection and a quick disconnection feature between said receiver housing and said holder.

13. A launcher, comprising:

a. a barrel, said barrel having a muzzle end and an opposing magazine end;

b. a receiver in operational connection with said barrel so that a projectile can be fired from said receiver through said barrel from said magazine end of said barrel to and out of said muzzle end of said barrel, said receiver having a barrel end and an opposing trigger end, said receiver having an upper side and an opposing lower side, said receiver having a right side and an opposing left side;

c. a receiver housing for carrying said receiver and said barrel, said receiver housing having a receiver housing barrel end and an opposing receiver housing trigger end, a forward hand grip and a rear hand grip;

d. said receiver housing having a receiver housing upper side and an opposing receiver housing lower side, said receiver housing having a receiver housing right side and an opposing receiver housing left side;

e. a stock attached to said receiver and in operational connection with said receiver and said receiver housing;

f. a trigger, said trigger carried by said receiver, said trigger located between said rear hand grip and said stock;

g. a compressed gas container carried by and in operational connection with said receiver and said receiver housing so that gas from said compressed gas container can be used to discharge a projectile from said barrel; and h. a magazine well for receiving a projectile magazine, said magazine well carried by said receiver housing between said forward hand grip and said rear hand grip.

14. The launcher as recited in claim 13, further comprising a compressed gas container mounting bracket integrally formed on said receiver housing for operationally connecting said compressed gas container to said receiver housing.

15. The launcher as recited in claim 14, wherein said compressed gas container mounting bracket is located between said projectile magazine when received by said receiver housing and said muzzle end of said barrel.

16. The launcher as recited in claim 14; wherein said compressed gas container mounting bracket is located between said projectile magazine when received by said receiver housing and said muzzle end of said barrel.

17. The launcher as recited in claim 14, further comprising a mounting clip having a release mechanism, said mounting clip is attached to said compressed gas container for mounting said compressed gas container onto said receiver housing by inserting said mounting clip into said compressed gas container mounting bracket, said release mechanism is used for releasing said mounting clip from said compressed gas container mounting bracket.

18. A launcher system, said system comprising:

a. a barrel, said barrel having a muzzle end and an opposing chamber end;

b. a receiver in operational connection with said barrel so that a projectile can be fired from said receiver through said barrel, said receiver having a barrel end and an opposing trigger end;

c. a receiver housing, said receiver housing carrying said receiver, said receiver housing having a front hand grip, a rear hand grip, and a magazine well formed between said front hand grip and said rear hand grip;

d. a projectile magazine received within said receiver for holding plural projectiles; and e. means for detachably mounting said receiver and said receiver housing onto a holder having a stock.

19. The launcher system as recited in claim 18, wherein said holder is a rifle.

20. The launcher system as recited in claim 18, wherein said holder is a military rifle.

* * * * *

UNITED STATES PATENT AND TRADEMARK OFFICE

CERTIFICATE OF CORRECTION

PATENT NO. : 6,752,137 B2
APPLICATION NO. : 10/146003
DATED : June 22, 2004
INVENTOR(S) : James Brunette et al.

It is certified that error appears in the above-identified patent and that said Letters Patent is hereby corrected as shown below:

Title Page, Item (73) Assignee: Should Read,
Assignee: FN Manufacturing, LLC, Columbia, SC Signed and Sealed this Twenty-fifth Day of November, 2008

JON W. DUDAS
*Director of the United States Patent and Trademark Office*